US009750377B2

(12) United States Patent
Bai

(10) Patent No.: US 9,750,377 B2
(45) Date of Patent: Sep. 5, 2017

(54) FOAM GENERATOR

(71) Applicant: Peter Bai, Placentia, CA (US)

(72) Inventor: Peter Bai, Placentia, CA (US)

( * ) Notice: Subject to any disclaimer, the term of this patent is extended or adjusted under 35 U.S.C. 154(b) by 61 days.

(21) Appl. No.: 14/973,534

(22) Filed: Dec. 17, 2015

(65) Prior Publication Data

US 2017/0172357 A1 Jun. 22, 2017

(51) Int. Cl.

| | |
|---|---|
| ***A47K 5/14*** | (2006.01) |
| ***A47K 5/12*** | (2006.01) |
| ***B05B 7/00*** | (2006.01) |
| ***B05B 11/00*** | (2006.01) |

(52) U.S. Cl.

CPC ..... *A47K 5/14* (2013.01); *A47K 5/1211* (2013.01); *B05B 7/0037* (2013.01); *B05B 11/3001* (2013.01); *B05B 11/3047* (2013.01); *B05B 11/3087* (2013.01)

(58) Field of Classification Search

CPC .... A47K 5/14; A47K 5/1211; B05B 11/3047; B05B 11/3087; B05B 11/3001; B05B 7/0037

USPC ..... 222/190

See application file for complete search history.

(56) References Cited

U.S. PATENT DOCUMENTS

| | | | | |
|---|---|---|---|---|
| 5,443,569 A | 8/1995 | Uehira | | |
| 5,445,288 A | 8/1995 | Banks | | |
| 6,082,586 A * | 7/2000 | Banks | A47K 5/14 | 222/105 |
| 2005/0224519 A1* | 10/2005 | Law | B05B 7/0025 | 222/190 |

* cited by examiner

*Primary Examiner* — Donnell Long

(74) *Attorney, Agent, or Firm* — Clement Cheng

(57) ABSTRACT

A foam generator includes a container having a liquid. The container includes a container neck. A bubble generator is mounted to the container. The bubble generator has a liquid piston and an air piston that are mechanically connected together to simultaneously dispense the liquid and a flow of air. The liquid piston extends into the container as a bubble generator input stem. The liquid is received into the bubble generator input stem at a liquid piston intake of the bubble generator input stem. The air piston and the liquid piston feed both air and liquid to a mixing chamber that provides both air and liquid to a pair of mixing screens mounted on a bubble generator output stem. The bubble generator output stem is oriented below the bubble generator input stem. An inverted straw cover fits over the liquid piston intake of the input stem.

16 Claims, 4 Drawing Sheets

FOAM GENERATOR

FIELD OF THE INVENTION

The present invention is in the field of foam generators.

DISCUSSION OF RELATED ART a variety of different foam generators have been used for generating large numbers of bubbles, such as U.S. Pat. No. 6,082,586 by inventor Stuart Banks issued Jul. 4, 2000, entitled liquid dispenser for dispensing foam, the disclosure of which is incorporated herein by reference.

The banks reference provides for a foam generator that has a flexible seal for an air pump chamber. The air seal is angled outwardly toward a first enclosure member and engaging a first enclosure member.

SUMMARY OF THE INVENTION

A foam generator includes a container having a liquid. The container includes a container neck. A bubble generator is mounted to the container. The bubble generator has a liquid piston and an air piston that are mechanically connected together to simultaneously dispense the liquid and a flow of air. The liquid piston extends into the container as a bubble generator input stem. The liquid is received into the bubble generator input stem at a liquid piston intake of the bubble generator input stem. The air piston and the liquid piston feed both air and liquid to a mixing chamber that provides both air and liquid to a pair of mixing screens mounted on a bubble generator output stem. The bubble generator output stem is oriented below the bubble generator input stem. An inverted straw cover fits over the liquid piston intake of the input stem. The inverted straw cover has an inverted straw cover fluid channel that draws liquid from the container upward beginning at an inverted straw liquid intake located below the liquid piston intake of the bubble generator input stem.

Preferably, the foam generator has a nozzle removably mounted over the output stem for directing a flow of generated foam downward. An air gap cavity can be formed at an upper end of the inverted straw cover. The inverted straw cover fluid channel is formed on a protruding ridge, and the protruding ridge is regularly oriented and extends from an inverted straw cover shoulder. The annular fluid collection trough is located around the bubble generator input stem below a level of the inverted straw liquid intake. The annular fluid collection trough is formed between a conical toroid inside trough wall and a conical toroid diagonal trough wall.

The foam generator has a conical toroid diagonal trough wall that is generally diagonally oriented and a conical toroid inside trough wall that is generally vertically oriented. A locking sleeve locks the bubble generator to the container. Latching rim slots formed on an upper edge of the bubble generator locking sleeve define fingers that hook to the foam generator. The locking sleeve latching rim is formed as a triangular plastic hook that hooks onto a bubble generator external sidewall upper edge.

Figure 1:
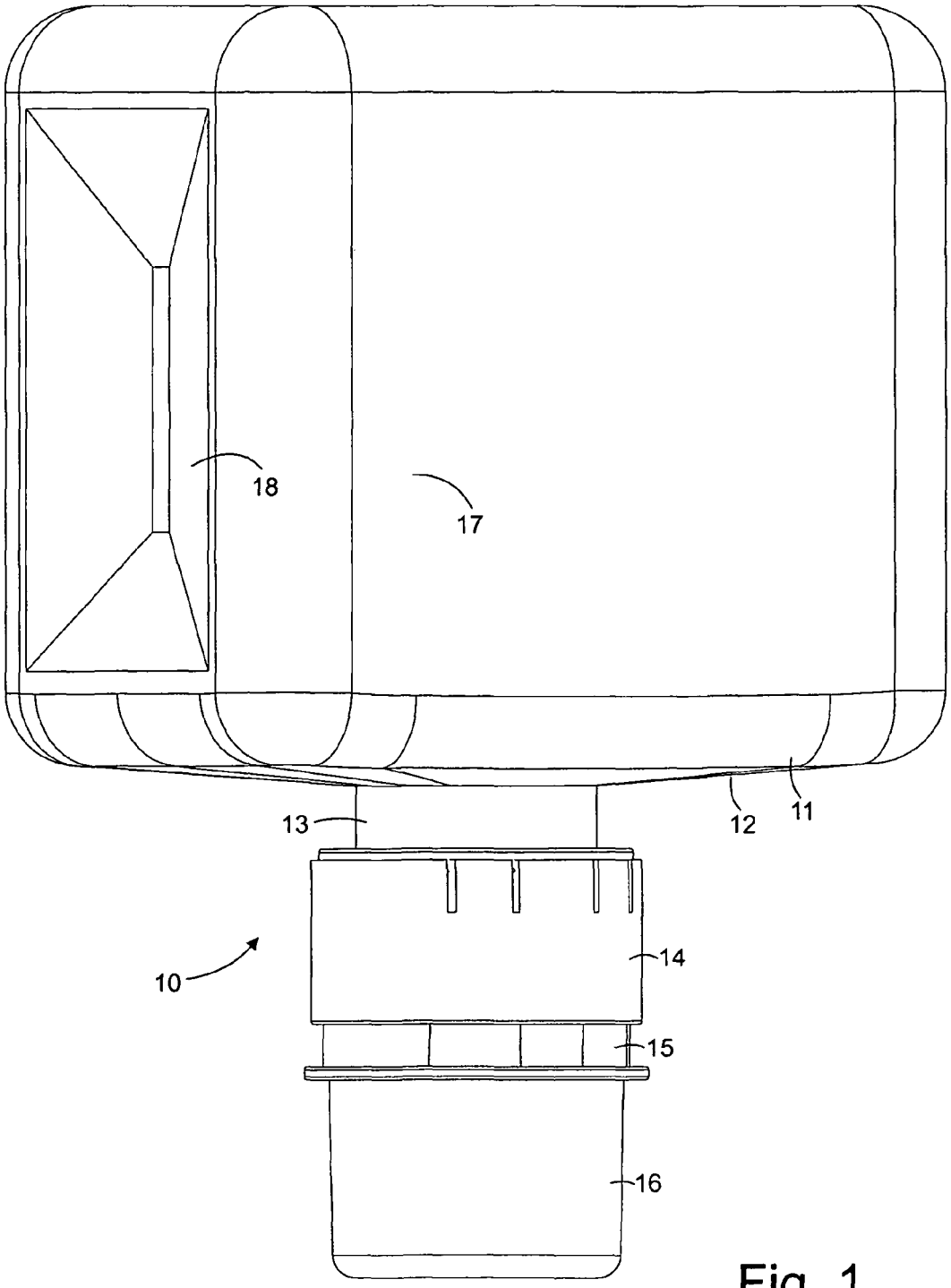
FIG. 1 is a perspective view of the foam generator present invention.
Figure 2:
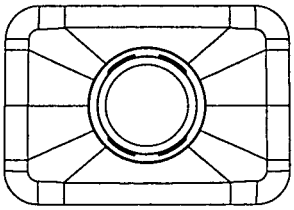
FIG. 2 is a bottom view of the present invention.
Figure 3:
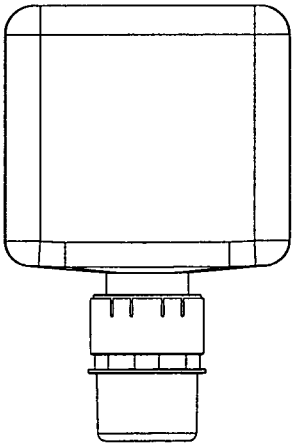
FIG. 3 is a front view of the present invention.
Figure 5:
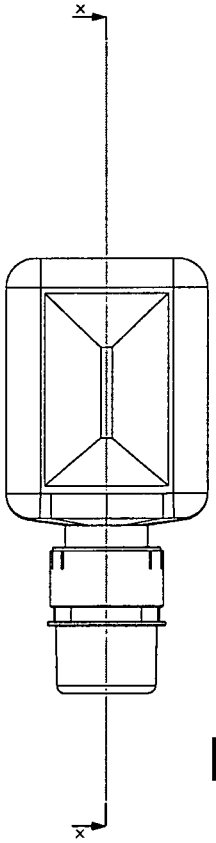
FIG. 5 is a side view of the present invention.
Figure 4:
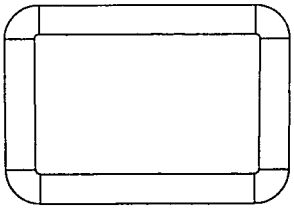
FIG. 4 is a top view of the present invention.
Figure 6:
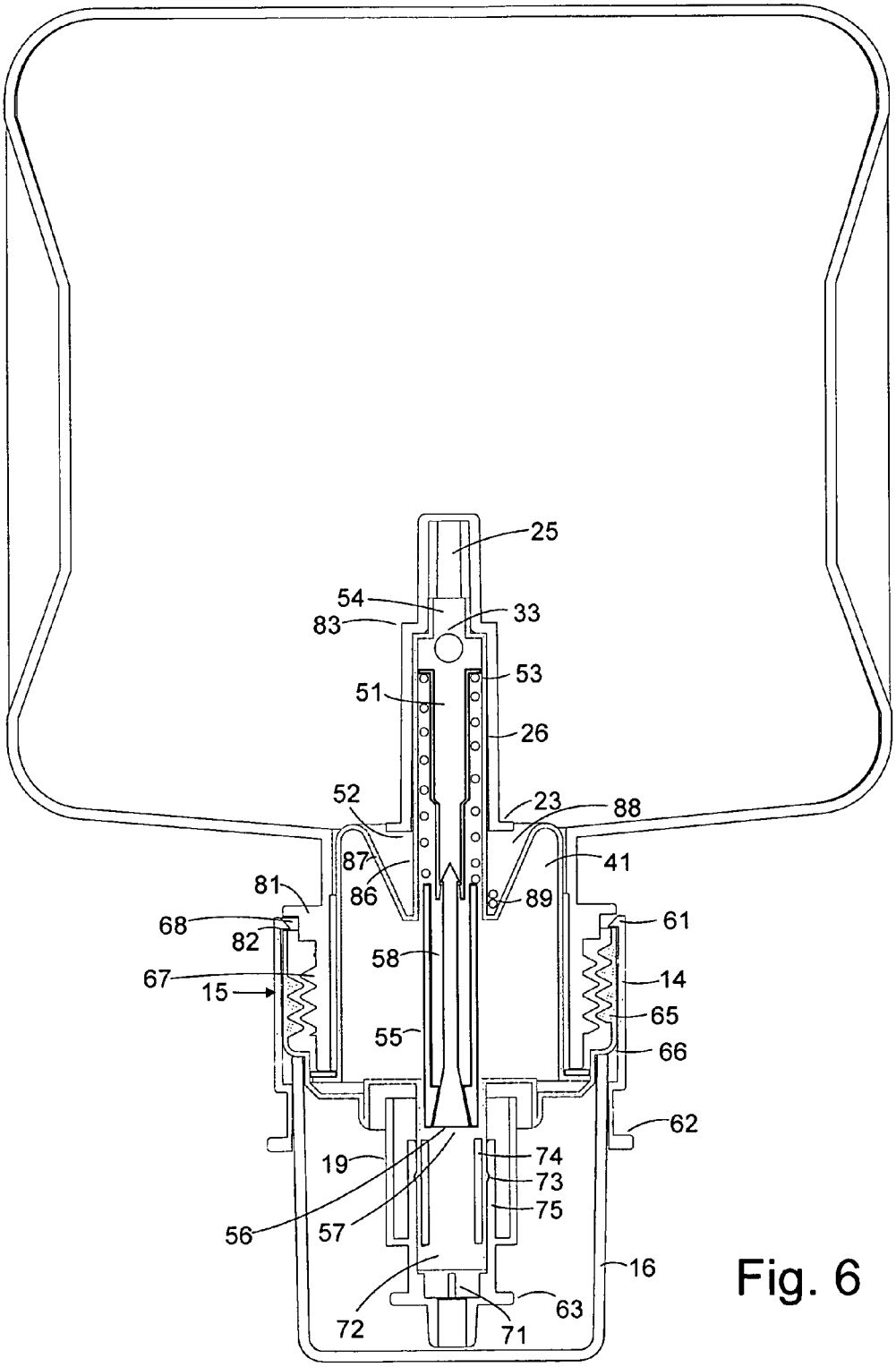
FIG. 6 is a front cross-section view of the present invention sectioned at a bisecting plane shown as section line x defined on FIG. 5.
Figure 7:
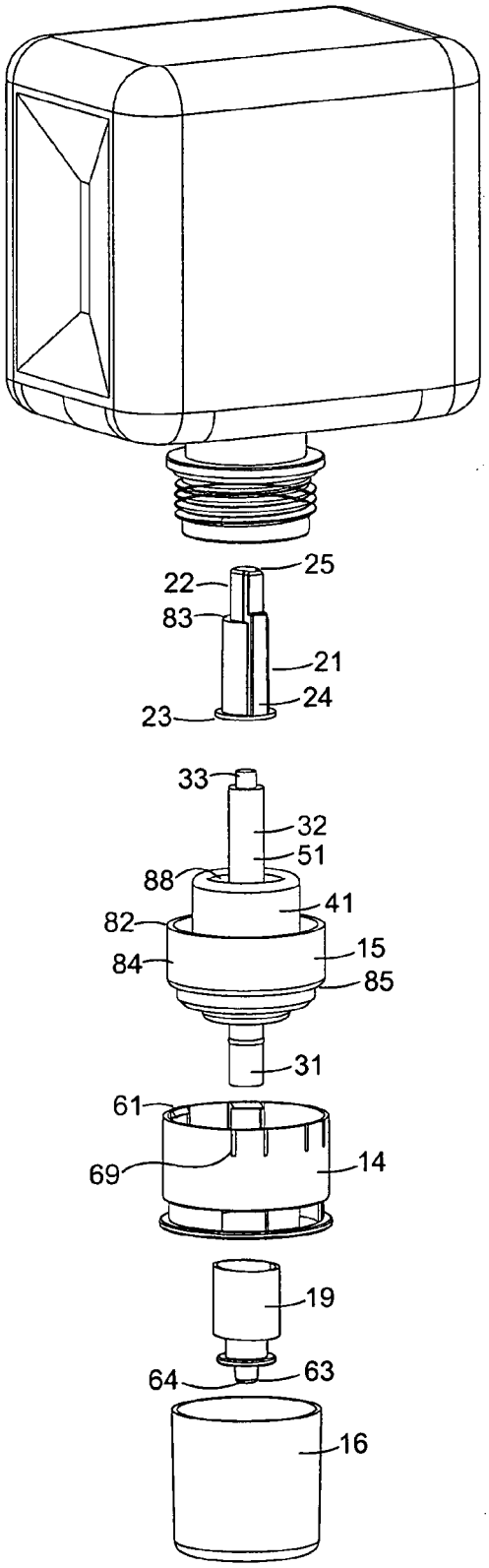
FIG. 7 is an exploded view of the present invention.

The following callout list of elements can be a useful guide in referencing the elements of the drawings.

10 foam generator
11 container
12 container shoulder
13 container neck
14 bubble generator locking sleeve
15 bubble generator
16 nozzle cover
17 container side
18 container crumple fold area indent
19 nozzle
21 inverted straw cover
22 inverted straw cover tip
23 inverted straw cover flange
24 protruding ridge
25 air gap
26 inverted straw cover fluid channel
31 bubble generator output stem
32 bubble generator input stem
33 inlet ball valve
41 air piston
51 liquid piston
52 inverted straw liquid intake
53 liquid piston spring
54 liquid piston intake
55 liquid piston compressor
56 liquid piston exit valve
57 liquid piston exit opening
58 liquid piston valve shaft
61 locking sleeve latching rim
62 locking sleeve lower flange
63 nozzle flange
64 nozzle tip
65 bubble generator thread
66 locking sleeve interface
67 container thread
68 locking sleeve latching groove
69 latching rim slots
71 mixing screens
72 mixing chamber
73 air intake valve
74 air intake flapper
75 air intake opening
81 neck ring
82 bubble generator external sidewall upper edge
83 inverted straw cover shoulder
84 bubble generator external sidewall
85 bubble generator external sidewall lower edge
86 conical toroid inside trough wall
87 conical toroid diagonal trough wall
88 annular fluid collection trough
89 undissolved solids

DETAILED DESCRIPTION OF THE PREFERRED EMBODIMENT

The foam generator 10 has a container 11 with a generally hollow body that can be watertight and hold liquids such as foam liquid soap and bubble soap. The soap can have vitamin E and moisturizer in it as well as a variety of different scented fragrances such as lavender and rosemary. The container has a container shoulder 12 defining a rectangular prism from which a container neck 13 extends. The container neck can be integrally formed with the main container body that is generally formed as a rectangular prism. The container can be made of plastic. A bubble generator locking sleeve 14 secures a bubble generator 15 to the threaded portion of the container neck. A nozzle cover 16 covers the nozzle of the bubble generator. The container has a container side 17. A plurality of container sides can form various faces of the container body. Some of the container sides have a container crumple fold area indent 18 for allowing collapsability of the container as the container is emptied.

An inverted straw cover 21 has an inverted straw cover tip 22. The inverted straw also has an inverted straw cover flange 23. The inverted straw cover tip points up and is at an opposite end of the inverted straw cover flange. The inverted straw cover flange extends away from the inverted straw cover at a lower edge of the inverted straw cover. The inverted straw cover optionally includes a protruding ridge 24. The protruding ridge allows liquid to be received into the inverted straw cover. The air gap 25 is located above the protruding ridge and can receive any air that collects in the inverted straw cover. The protruding ridge houses an inverted straw cover fluid channel 26 which can be formed as a passage through the protruding ridge. Optionally, the inverted straw cover fluid channel 26 can be formed as a gap between the inverted straw cover and the bubble generator to which the inverted straw cover is attached. The inverted straw cover receives a flow of fluid that passes from the container to the inverted straw cover fluid channel, and then to the bubble generator. The inverted straw cover optionally is formed with an inverted straw cover shoulder 83 that has an inside surface that fits onto the bubble generator input stem 32. The inverted straw cover 21 can be formed as a plastic cover that acts as a straw for drawing liquid starting from a bottom portion of the container 11. The liquid is drawn upward through the straw to the liquid piston intake 54. The liquid piston 51 can be coaxial to the straw such that the straw covers or encapsulates at least a portion of the liquid piston 51.

The bubble generator has a bubble generator output stem 31 that is below a bubble generator input stem 32. The inverted straw cover 21 fits over the bubble generator input stem 32 in an interference fit, or a partially threaded connection. The bubble generator input stem 32 preferably includes an inlet ball valve 33 that receives fluid into the input stem, but does not allow fluid to exit from the input stem. The inlet ball valve can be a plastic floating ball, or a metal ball. The inlet ball valve ball can be biased by a spring such as a helical spring.

An air piston 41 receives air from an air intake. The air piston is mechanically coordinated to move simultaneously with the liquid piston 51. As the air piston moves with the liquid piston, both pistons draw air and liquid in a drawing phase and then expel air and liquid in an expulsion phase. In the drawing phase, liquid passes into the inverted straw liquid intake 52 formed as an opening on the inverted straw cover 21. The inverted straw liquid intake 52 is above an excess reservoir that collects waste fluid. The liquid piston has a liquid piston spring 53 that biases the liquid piston from a retracted position to an extended position to provide a spring bias for mechanically inducing the drawing phase. The liquid piston spring draws air as well as liquid since the air piston and liquid piston are mechanically connected. A liquid piston intake 54 receives fluid into the liquid piston and the liquid piston intake is directly above the inlet ball valve 33. The liquid piston has a liquid piston compressor 55. The liquid piston compressor pushes the liquid out of the liquid piston exit valve 56. The liquid piston exit valve 56 is mounted over a liquid piston exit opening 57 and is a one-way valve just like the intake ball valve is a one-way valve. The liquid piston exit valve 56 can be connected to a liquid piston valve shaft 58 that abuts a portion of the liquid piston 51 after traveling a certain distance. Thus, changing a length of the liquid piston valve shaft 58 can provide a calibration of the amount of air and liquid being dispensed.

As described above, the bubble generator locking sleeve 14 fits over the entire bubble generator 15 to lock it to the container and provide a tamper-resistant seal. The bubble generator locking sleeve 14 preferably has a locking sleeve latching rim 61 that can have a triangular hook end biased over an external surface of the bubble generator such as over the bubble generator external sidewall 84. The locking sleeve lower flange 62 extends outward as an annular ring that can allow the foam generator to be mounted to a dispenser such as a wall-mounted bathroom manual push dispenser for example. When mounted on a standard dispenser, the nozzle 19 is preferably fitted with a nozzle flange 63 near or immediately above the nozzle tip 64. The nozzle flange 63 can be pressed against the locking sleeve lower flange 62.

The nozzle tip 64 can be made removable to provide ease of cleaning the nozzle tip. The bubble generator external sidewall 84 is at an external surface of the bubble generator. The bubble generator external sidewall 84 has an internal bubble generator thread 65 that engages container thread 67 formed on the container 11. The bubble generator locking sleeve 14 fits over the bubble generator external sidewall 84 so that rotation of the bubble generator locking sleeve 14 slides a smooth inside surface of the sleeve along a smooth bubble generator external sidewall 84 so that manual turning does not allow rotation of the bubble generator away from the container thread 67 after the bubble generator locking sleeve 14 is snap fitted over the bubble generator external sidewall 84. The locking sleeve interface 66 is a smooth bubble generator locking sleeve 14 that can freely rotate around the bubble generator external sidewall 84 as a rotating bearing.

The locking sleeve engages on a locking sleeve latching groove 68. The locking sleeve latching rim 61 has triangular cross section plastic hooks that have a pointed tip for biasing into the locking sleeve latching groove 68. The latching rim has latching rim slots 69 that segment the locking sleeve latching rim 61 into a plurality of fingers that engage onto the locking sleeve latching groove 68. The container 11 has a neck ring 81. The neck ring 81 cooperates with the bubble generator external sidewall upper edge 82 to form a locking sleeve latching groove 68 between them.

A variety of different mixing screens 71 receives a flow of liquid and air simultaneously from the air piston 41 and the liquid piston 51. The flow of liquid and air are received in the mixing chamber 72 and then pushed through the mixing screens to create a multitude of bubbles sufficient for forming foam. The air intake valve 73 can be formed near the mixing chamber 72 and can be mounted on an air intake opening covered by an air intake flapper 74 that acts as a one-way valve for receiving air into the mixing chamber 72. The mixing chamber 72 has air that can pass into the air piston 41. The air intake flapper 74 can be made as a thin plastic or rubber sheet that allows air to enter through an air intake opening 75, but does not allow air to exit through the air intake opening 75. In this way, the pump continuously produces foam in a reciprocating manner when a user depresses the nozzle flange upward either manually or via a dispenser mechanism. A dispenser mechanism can be wall-mounted such as on a bathroom wall for convenience.

The bubble generator preferably has a bubble generator external sidewall 84 that has a bubble generator external sidewall lower edge 85 at a lower edge of the bubble generator external sidewall 84 and a bubble generator external sidewall upper edge 82 at an upper edge of the bubble generator external sidewall. The bubble generator lower edge 85 and bubble generator external sidewall upper edge 82 are both preferably covered by the bubble generator locking sleeve 14.

Near the inverted straw liquid intake 52 at the beginning of the container neck 13, a conical toroid inside trough wall 86 meets with a conical toroid diagonal trough wall 87 to form an annular fluid collection trough 88 that can collect undissolved solids 89. The annular fluid collection trough 88 is ring-shaped around the inverted straw liquid intake 52 and is formed around the liquid piston 51. The liquid piston 51 can be adapted for receiving liquid soap such as liquid foam soap. The annular fluid collection trough 88 has a downwardly pointing tip that is located below the inverted straw liquid intake 52. A separation zone is created between the annular fluid collection trough and the inverted straw liquid intake.

As can be seen from the above description and drawings, the objects of the invention are at least twofold, namely first to provide an annular fluid collection trough 88 to collect any undissolved solids 89 that may form or be introduced in the liquid stored in the container 11 to prevent them from jamming the bubble mechanism. Also, secondly, the locking sleeve latching rim retains the bubble generator tightly to the neck of the container to provide a tamper-resistant seal.

The locking sleeve latching rim is preferably formed with a locking sleeve latching groove that is located immediately above the locking sleeve latching rim. The locking sleeve latching groove is preferably rectangular in configuration for receiving a connection to a dispenser body.

The invention claimed is:

1. A foam generator comprising:

a container having a liquid, wherein the container includes a container neck;

a bubble generator mounted to the container, wherein the bubble generator has a liquid piston and an air piston that are mechanically connected together to simultaneously dispense the liquid and a flow of air, wherein the liquid piston extends into the container as a bubble generator input stem, wherein the liquid is received into the bubble generator input stem at a liquid piston intake of the bubble generator input stem, wherein the air piston and the liquid piston feed both air and liquid to a mixing chamber that provides both air and liquid to a pair of mixing screens mounted on a bubble generator output stem, wherein the bubble generator output stem is oriented below the bubble generator input stem;

an inverted straw cover fitting over the liquid piston intake of the input stem, wherein the inverted straw cover has an inverted straw cover fluid channel that draws liquid from the container upward beginning at an inverted straw liquid intake located below the liquid piston intake of the bubble generator input stem; and a locking sleeve locking the bubble generator to the container, wherein the locking sleeve comprises a locking sleeve latching rim that is formed as a triangular plastic hook that hooks onto a bubble generator external sidewall upper edge.

2. The foam generator of claim 1, further including a nozzle removably mounted over the output stem, for directing a flow of generated foam downward.

3. The foam generator of claim 1, further including an air gap cavity formed at an upper end of the inverted straw cover.

4. The foam generator of claim 1, wherein the inverted straw cover fluid channel is formed on a protruding ridge, wherein the protruding ridge extends from an inverted straw cover shoulder.

5. The foam generator of claim 1, further including an annular fluid collection trough located around the bubble generator input stem below a level of the inverted straw liquid intake.

6. The foam generator of claim 5, wherein the annular fluid collection trough is formed between a conical toroid inside trough wall and a conical toroid diagonal trough wall.

7. The foam generator of claim 6, wherein the conical toroid diagonal trough wall is generally diagonally oriented.

8. The foam generator of claim 6, wherein the conical toroid inside trough wall is generally vertically oriented.

9. The foam generator of claim 6, wherein the conical toroid diagonal trough wall is generally diagonally oriented and, wherein the conical toroid inside trough wall is generally vertically oriented.

10. The foam generator of claim 1, further comprising: a plurality of latching rim slots formed on an upper edge of the bubble generator locking sleeve.

11. The foam generator of claim 1, further including a nozzle removably mounted over the output stem, for directing a flow of generated foam downward.

12. The foam generator of claim 1, further including an air gap cavity formed at an upper end of the inverted straw cover.

13. The foam generator of claim 1, wherein the inverted straw cover fluid channel is formed on a protruding ridge, wherein the protruding ridge extends from an inverted straw cover shoulder.

14. The foam generator of claim 1, further including an annular fluid collection trough located around the bubble generator input stem below a level of the inverted straw liquid intake.

15. The foam generator of claim 14, wherein the annular fluid collection trough is formed between a conical toroid inside trough wall and a conical toroid trough wall.

16. The foam generator of claim 15, wherein the conical toroid diagonal trough wall is generally diagonally oriented.

* * * * *